US012765692B2

(12) United States Patent
Yahagi et al.

(10) Patent No.: US 12,765,692 B2
(45) Date of Patent: Oct. 20, 2026

(54) AIR BLOWING ADJUSTMENT APPARATUS AND BEDDING

(71) Applicant: Paramount Bed Co., Ltd., Tokyo (JP)

(72) Inventors: Ryosuke Yahagi, Koto-ku (JP); Makoto Tanaka, Koto-ku (JP); Kosuke Takano, Koto-ku (JP)

(73) Assignee: Paramount Bed Co., Ltd., Tokyo (JP)

( * ) Notice: Subject to any disclaimer, the term of this patent is extended or adjusted under 35 U.S.C. 154(b) by 0 days.

(21) Appl. No.: 19/274,905

(22) Filed: Jul. 21, 2025

(65) Prior Publication Data

US 2026/0294126 A1 Oct. 1, 2026

(30) Foreign Application Priority Data

Mar. 27, 2025 (JP) ..... 2025-053719

(51) Int. Cl.
*A47C 27/08* (2006.01)
*A47C 27/10* (2006.01)

(52) U.S. Cl.
CPC ..... *A47C 27/083* (2013.01); *A47C 27/082* (2013.01); *A47C 27/10* (2013.01)

(58) Field of Classification Search
CPC ..... A47C 27/083; A47C 27/082; A47C 27/10
See application file for complete search history.

(56) References Cited

U.S. PATENT DOCUMENTS 6,686,711 B2 * 2/2004 Rose ..... G05D 16/2066 318/16
2021/0204718 A1 * 7/2021 Ohno ..... A47C 31/008

FOREIGN PATENT DOCUMENTS

JP 5-68628 A 3/1993

* cited by examiner

*Primary Examiner* — Sabbir Hasan
(74) *Attorney, Agent, or Firm* — Oblon, McClelland, Maier & Neustadt, L.L.P.

(57) ABSTRACT

An air blowing adjustment apparatus includes a controller configured to control an air blowing section configured to supply air to an air cell. A flow path that connects the air blowing section to the air cell includes a first flow path part connected to the air blowing section and a second flow path part that connects the air cell to the first flow path part, and is provided with a solenoid valve configured to open and close between the first flow path part and the second flow path part. The controller is configured to perform, based on closing pressure that is internal pressure in the first flow path part when the solenoid valve is closed and the air blowing section is operated, duty adjustment control to update a duty ratio in the operation of the air blowing section.

9 Claims, 6 Drawing Sheets

AIR BLOWING ADJUSTMENT APPARATUS AND BEDDING

CROSS-REFERENCE TO RELATED APPLICATIONS

This application is based upon and claims the benefit of priority from Japanese Patent Application No. 2025-053719, filed on Mar. 27, 2025; the entire contents of which are incorporated herein by reference.

FIELD

An embodiment of the present disclosure relates to an air blowing adjustment apparatus and bedding.

BACKGROUND

Air mattresses in which a pump supplies the air to air cells to adjust the internal pressure in the air cells are known.

DETAILED DESCRIPTION

Figure 1:
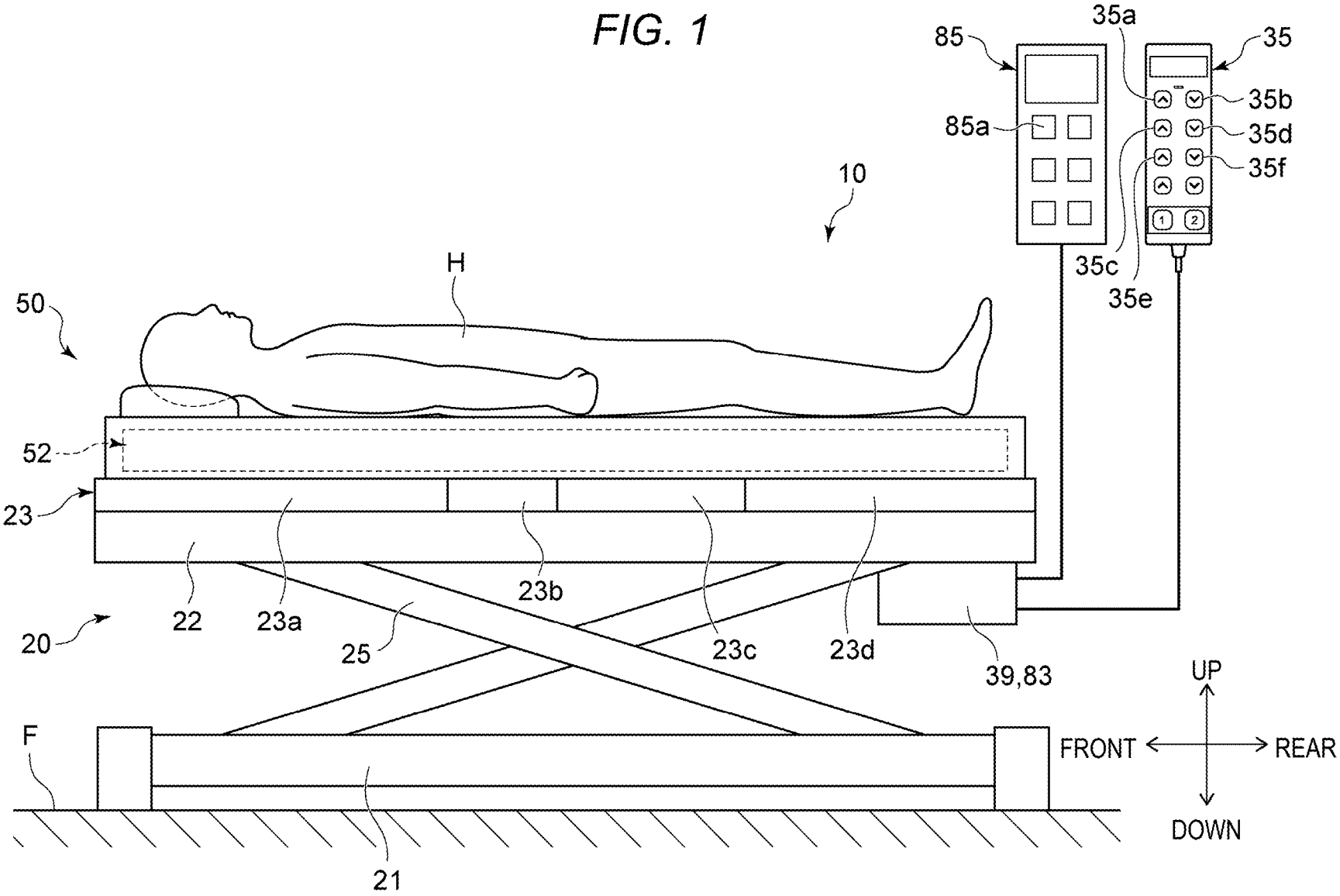
FIG. 1 is a side view illustrating a motorized bed unit provided with an air mattress according to an embodiment.

One or more embodiments are now described with reference to the drawings, wherein like reference numerals are used to refer to like elements throughout. In the following description, for purposes of explanation, numerous specific details are set forth in order to provide a thorough understanding of the various embodiments. It is evident, however, that the various embodiments can be practiced without these specific details (and without applying to any particular networked environment or standard).

As used in this disclosure, in some embodiments, the terms "component," "system" and the like are intended to refer to, or comprise, a computer-related entity or an entity related to an operational apparatus with one or more specific functionalities, wherein the entity can be either hardware, or a combination of hardware and software in execution.

One or more components may reside within a process and/or thread of execution and a component may be localized on one computer and/or distributed between two or more computers. In addition, these components can execute from various computer readable media having various data structures stored thereon. The components may communicate via local and/or remote processes such as in accordance with a signal having one or more data packets (e.g., data from one component interacting with another component in a local system, distributed system, and/or across a network such as the Internet with other systems via the signal). As another example, a component can be an apparatus with specific functionality provided by mechanical parts operated by electric or electronic circuitry, which is operated by a software application or firmware application executed by a processor, wherein the processor can be internal or external to the apparatus and executes at least a part of the software or firmware application. As yet another example, a component can be an apparatus that provides specific functionality through electronic components without mechanical parts, the electronic components can comprise a processor therein to execute software stored on a non-transitory electronic memory or firmware that confers at least in part the functionality of the electronic components. While various components have been illustrated as separate components, it will be appreciated that multiple components can be implemented as a single component, or a single component can be implemented as multiple components, without departing from example embodiments. Further, the various embodiments can be implemented as a method, apparatus or article of manufacture using standard programming and/or engineering techniques to produce software, firmware, hardware or any combination thereof to control a computer to implement the disclosed subject matter. The term "article of manufacture" as used herein is intended to encompass a computer-readable (or machine-readable) device or computer-readable (or machine-readable) storage/communications media having a computer program stored thereon. For example, computer readable storage media can comprise, but are not limited to, magnetic storage devices (e.g., hard disk, floppy disk, magnetic strips), optical disks (e.g., compact disk (CD), digital versatile disk (DVD)), smart cards, and flash memory devices (e.g., card, stick, key drive). Of course, those skilled in the art will recognize many modifications can be made to this configuration without departing from the scope or spirit of the various embodiments.

In addition, the words "example" and "exemplary" are used herein to mean serving as an instance or illustration. Any embodiment or design described herein as "example" or "exemplary" is not necessarily to be construed as preferred or advantageous over other embodiments or designs. Rather, use of the word example or exemplary is intended to present concepts in a concrete fashion. As used in this application, the term "or" is intended to mean an inclusive "or" rather than an exclusive "or". That is, unless specified otherwise or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Embodiments described herein can be exploited in substantially any wireless communication technology, comprising, but not limited to, wireless fidelity (Wi-Fi), global system for mobile communications (GSM), universal mobile telecommunications system (UMTS), worldwide interoperability for microwave access (WiMAX), enhanced general packet radio service (enhanced GPRS), third generation partnership project (3GPP) long term evolution (LTE), third generation partnership project 2 (3GPP2) ultra mobile broadband (UMB), high speed packet access (HSPA), Z-Wave, Zigbee and other 802.XX wireless technologies and/or legacy telecommunication technologies.

In general, one aspect of the present application is, an air blowing adjustment apparatus includes:

a controller configured to control an air blowing section configured to supply air to an air cell, in which a flow path that connects the air blowing section to the air cell includes a first flow path part connected to the air blowing section and a second flow path part that connects the air cell to the first flow path part, and is provided with a solenoid valve configured to open and close between the first flow path part and the second flow path part, and the controller is configured to perform, based on closing pressure that is internal pressure in the first flow path part when the solenoid valve is closed and the air blowing section is operated, duty adjustment control to update a duty ratio in the operation of the air blowing section.

Hereinafter, an embodiment of the present disclosure will be described with reference to the drawings.

In the description and the drawings, components similar to those described previously with reference to earlier drawings are denoted by the same reference numerals, and detailed descriptions thereof will be omitted as appropriate.

FIG. 1 is a schematic view illustrating an example of bedding provided with an air blowing adjustment apparatus according to the embodiment. Specifically, in this example, the bedding is an air mattress, and FIG. 1 is a side view illustrating a motorized bed unit provided with the air mattress. The air blowing adjustment apparatus, which is described later, is an apparatus that adjusts air supply/exhaust of air cells included in the bedding (in this example, air mattress).

The bedding is not necessarily limited to the air mattress, but may be a pillow or a cushion. The air blowing adjustment apparatus may be provided to, not necessarily limited to the bedding, but arbitrary furniture or apparatus (for example rehabilitation apparatus) including air cells to be inflated and deflated due to air supply/exhaust, and adjust the air supply/exhaust of the air cells.

A motorized bed unit 10 illustrated in FIG. 1 is used in a care facility, a hospital, and a home, for example, and is configured to be able to electrically raise and tilt a backrest, an upper leg part, and the like, and be able to electrically operate the height of a bed 20. The motorized bed unit 10 illustrated in FIG. 1 is illustrated in a simplified manner, in which illustration of a drive device for raising and tilting the backrest and the upper leg part, and changing the height of the bed 20 is omitted. In the embodiment, description will be made by indicating a head side and a foot side of a user H lying on the bed 20 as a front side and a rear side, respectively. The motorized bed unit 10 is provided with the bed 20, and an air mattress 50 provided to the bed 20.

The bed 20 includes a base frame 21 that is placed on a floor surface F, main frames 22 that are positioned above the base frame 21, and sections 23 that can be raised and tilted relative to the main frames 22. The two main frames 22 are provided apart from each other in a left-and-right direction (lateral direction) of the bed 20, and extend in a front-and-rear direction. The base frame 21 supports the main frames 22 via a lifting mechanism 25, for example.

The sections 23 include an upper surface, which is a placed surface of a mattress 52. As illustrated in FIG. 1, the sections 23 support the user H via the mattress 52. The sections 23 include a back section 23*a*, a seat section 23*b*, an upper leg section 23*c*, and a lower leg section 23*d*.

Below the sections 23, for example, a driving mechanism that drives the back section 23*a*, a driving mechanism that drives the upper leg section 23*c* and the lower leg section 23*d*, the lifting mechanism 25 that lifts up and lowers down the main frames 22 and the sections 23, and a bed controller 39 that controls an actuation of each mechanism, are provided. In each of the driving mechanisms and the lifting mechanism, a drive device including an electric cylinder is used.

A bed user interface device 35 is a remote controller for operating each drive device. The bed user interface device 35 is connected to the bed controller 39 in a wired or wireless manner. The user H and a care giver can raise and tilt the back section 23*a*, the upper leg section 23*c*, and the lower leg section 23*d*, and change the height of the bed 20 from the floor surface F, by operating operation buttons of the bed user interface device 35.

The bed user interface device 35 includes, for example, a back raising button 35*a*, a back lowering button 35*b*, a leg raising button 35*c*, a leg lowering button 35*d*, an ascending button 35*e*, and a descending button 35*f*. The back raising button 35*a* and the back lowering button 35*b* are for actuating the drive device that drives the back section 23*a*. The leg raising button 35*c* and the leg lowering button 35*d* are for actuating the drive device that drives the upper leg section 23*c* and the lower leg section 23*d*. The ascending button 35*e* and the descending button 35*f* are for actuating the drive device that lifts up and lowers down the main frame 22 and the sections 23.

An angle sensor 87 (see FIG. 2) detects an inclined angle of the back section 23*a* with respect to the horizontal direction. The angle sensor 87 detects, for example, a raising/tilting angle of the back section 23*a* with respect to the seat section 23*b*. The angle sensor 87 may detect an inclined angle of the back section 23*a* with respect to the horizontal direction when the sections 23 of the bed 20 are tilted upward, for example. The angle sensor 87 transmits the detected detection result to a mattress controller 83, for example.

The bed controller 39 includes, for example, a control circuit that controls the drive devices. The bed controller 39 is provided below the sections 23, for example. The bed controller 39 is connected to the bed user interface device 35. The bed controller 39 controls actuations of the drive devices based on the operation of the bed user interface device 35.

The bed controller 39 includes a memory. The memory may be an arbitrary storage device, such as a ROM or a RAM. Programs for actuating the respective drive devices are stored in the memory. The bed controller 39 actuates each drive device based on a command signal transmitted from the bed user interface device 35. The bed controller 39 transmits a command signal toward the mattress controller 83. For example, the bed controller 39 may transmit a command signal toward the mattress controller 83, based on a detection result of a back angle detected by an actuator and the like in the bed, for example.

Figure 2:
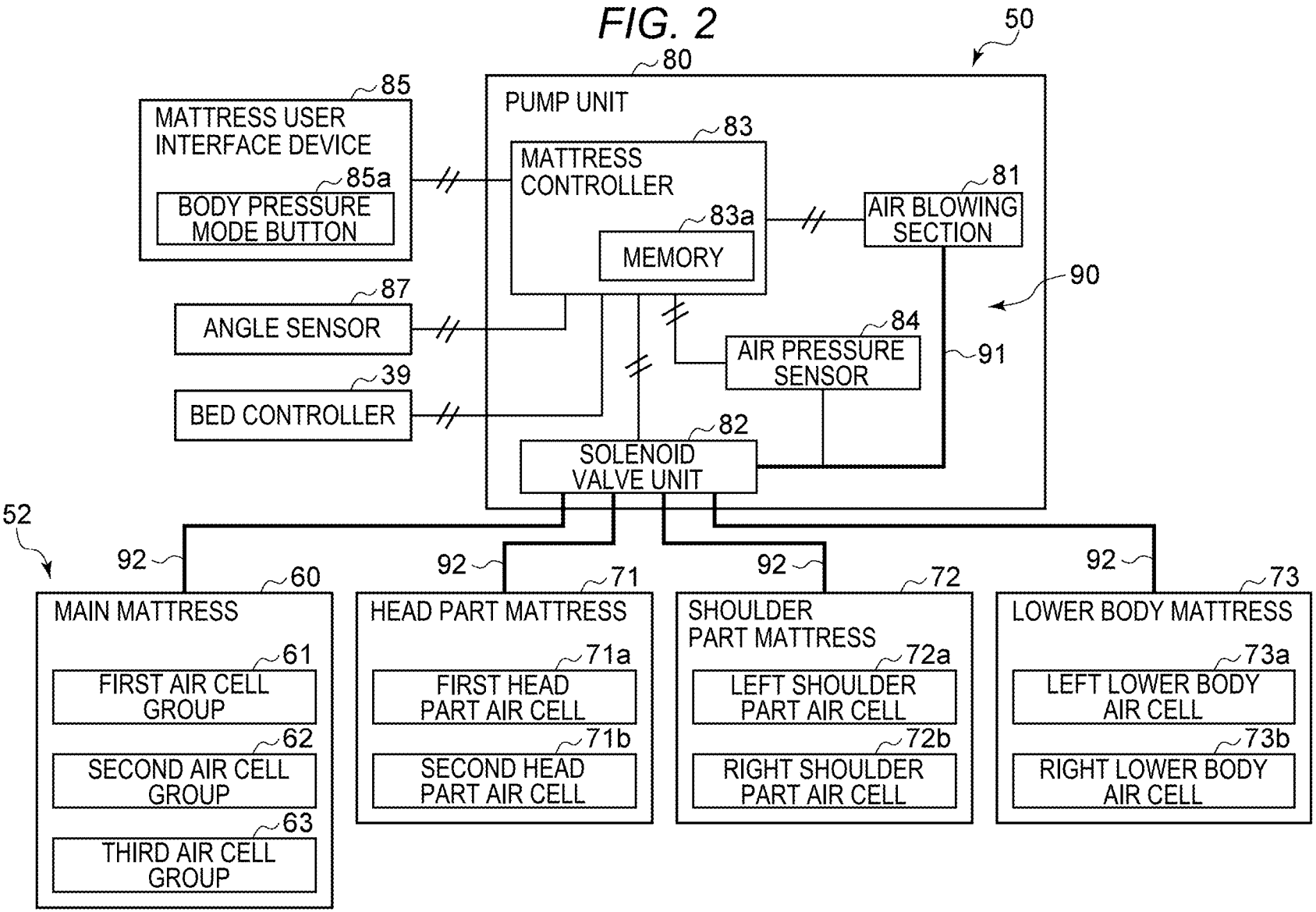
FIG. 2 is a block diagram illustrating a control system of the air mattress.

FIG. 2 is a block diagram illustrating a control system of the air mattress.

Figure 3:
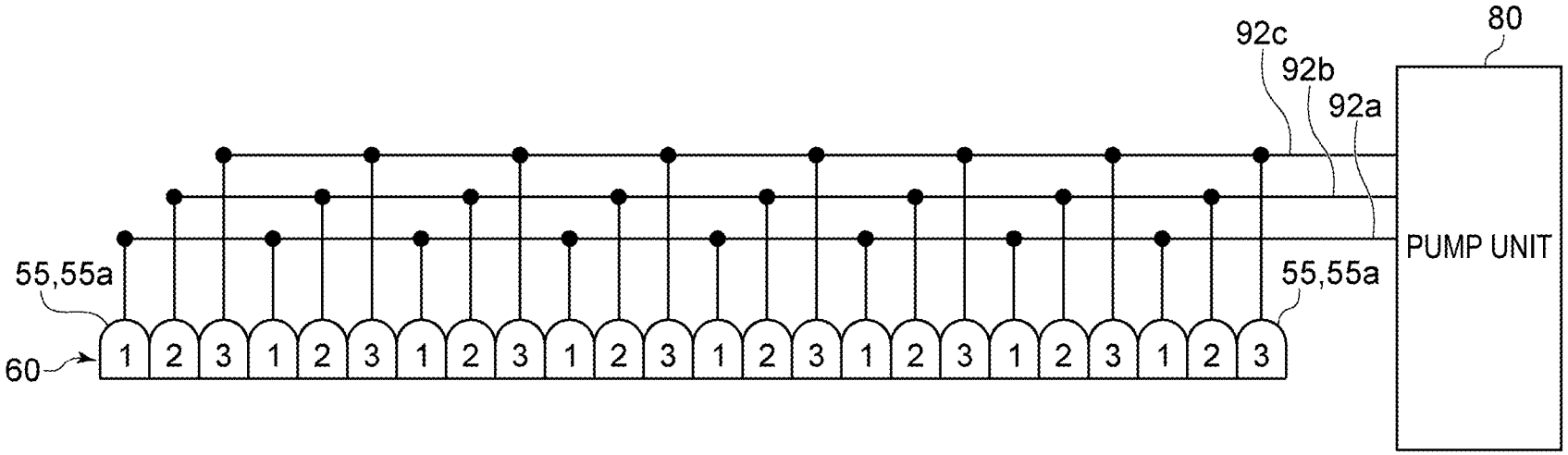
FIG. 3 is a diagram illustrating an air supply/exhaust system of the air mattress.
Figure 4:
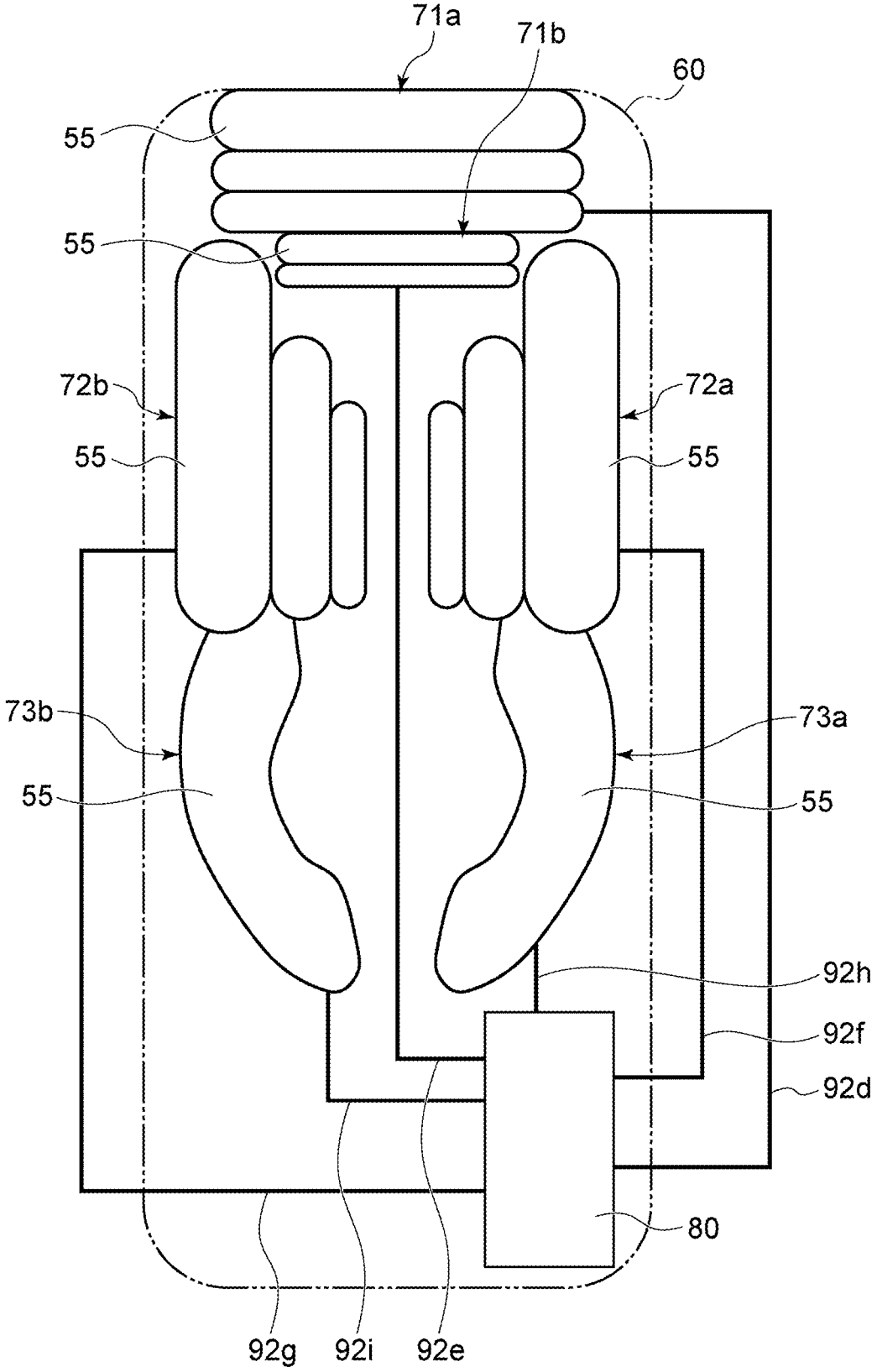
FIG. 4 is a diagram illustrating the air supply/exhaust system of the air mattress.

FIGS. 3 and 4 are diagrams illustrating an air supply/exhaust system of the air mattress.

As illustrated in FIG. 2, the air mattress 50 is provided with the mattress 52 that supports the user H, the mattress controller 83, and a mattress user interface device 85. The mattress 52 includes a plurality of air cells 55 (see FIGS. 3 and 4).

In the air mattress 50, the internal pressure of the plurality of air cells 55 is controlled to allow the mattress 52 to have a preferred hardness of the user H. In this example, a case where the bed 20 is provided with the air mattress 50 is described as an example. However, the air mattress 50 in which the mattress 52 is directly placed on the floor surface F may be used.

In this example, the mattress 52 includes a main mattress 60, a head part mattress 71, a shoulder part mattress 72, and a lower body mattress 73.

For example, the main mattress 60 is used in a case where body pressure of the user H is dispersed in a body pressure mode, which is described later. As illustrated in FIG. 3, the main mattress 60 includes, as the plurality of air cells 55, a plurality of air cells 55*a* arranged in the front-and-rear direction. One air cell 55*a* extends in accordance with the left-and-right direction (width direction) of the sections 23, for example. In this example, 24 pieces of the air cells 55*a* are arranged side by side in the front-and-rear direction. The plurality of air cells 55*a* are classified into three systems of a first air cell group 61, a second air cell group 62, and a third air cell group 63.

The air cells 55*a* denoted by "1" indicate the first air cell group 61. The air cells 55*a* denoted by "2" indicate the second air cell group 62. The air cells 55*a* denoted by "3" indicate the third air cell group 63. The air cells 55*a* for each group have the same air supply/exhaust system. In other words, the similar internal pressure control is executed in the air cells 55*a* denoted by the same number.

In this example, the air cells 55*a* of the main mattress 60 are arranged from the front side (head side) in the order of "1", "2", "3", "1" . . . , but the order of the air cells 55*a* of the main mattress 60 is not limited thereto. The air cells 55*a* in which air supply/exhaust is executed together are arbitrary arranged, and are not necessarily arranged in a regular order. For example, the main mattress 60 is classified into the respective air cell groups so as to disperse the comfortableness of the user H and the body pressure of the user H with high efficiency. In this example, the air cells 55*a* are classified into three groups, but may be classified into two groups or four or more groups.

The head part mattress 71 is positioned below the main mattress 60. The head part mattress 71 is disposed so as to be positioned below the head part of the user H. The head part mattress 71 includes a first head part air cell 71*a* and a second head part air cell 71*b*, as the plurality of air cells 55. In this example, each of the first head part air cell 71*a* and the second head part air cell 71*b* is an air cell group including the plurality of air cells 55. The second head part air cell 71*b* is disposed on the foot side of the first head part air cell 71*a*.

The shoulder part mattress 72 is positioned below the main mattress 60. The shoulder part mattress 72 includes a left shoulder part air cell 72*a* and a right shoulder part air cell 72*b*, as the plurality of air cells 55. In this example, each of the left shoulder part air cell 72*a* and the right shoulder part air cell 72*b* is an air cell group including the plurality of air cells 55. The left shoulder part air cell 72*a* is disposed so as to be positioned below the left shoulder of the user H. The right shoulder part air cell 72*b* is disposed so as to be positioned below the right shoulder of the user H.

The lower body mattress 73 is positioned below the main mattress 60. The lower body mattress 73 includes a left lower body air cell 73*a* and a right lower body air cell 73*b*, as the plurality of air cells 55. The left lower body air cell 73*a* is disposed so as to be positioned below the left lower body of the user H. The right lower body air cell 73*b* is disposed so as to be positioned below the right lower body of the user H.

The head part mattress 71, the shoulder part mattress 72, and the lower body mattress 73, in each of which the air cells 55 have inflated shapes due to the air-supply, assist the posture of the user H via the main mattress 60. For example, the air is supplied to the air cells 55 of the head part mattress 71, the shoulder part mattress 72, and the lower body mattress 73 with the operation of the sections 23 (for example, a back raising posture in which the back section 23*a* is raised). For example, the head part mattress 71 is used in a head-up mode in a case where the user H has a meal. For example, the shoulder part mattress 72 and the lower body mattress 73 support the user H so as to be wrapped in the left-and-right direction, thereby preventing posture collapse and falling of the user H.

The air supply/exhaust system of the first air cell group 61, the air supply/exhaust system of the second air cell group 62, the air supply/exhaust system of the third air cell group 63, the air supply/exhaust system of the first head part air cell 71*a*, the air supply/exhaust system of the second head part air cell 71*b*, the air supply/exhaust system of the left shoulder part air cell 72*a*, the air supply/exhaust system of the right shoulder part air cell 72*b*, the air supply/exhaust system of the left lower body air cell 73*a*, and the air supply/exhaust system of the right lower body air cell 73*b* may be air supply/exhaust systems different from one another. The internal pressure control different from one another can be independently made with respect to the air cells 55 having air supply/exhaust systems different from one another.

In the embodiment, the head part mattress 71, the shoulder part mattress 72, and the lower body mattress 73 may be provided if necessary, or may be omitted. The arrangement of the head part mattress 71, the shoulder part mattress 72, and the lower body mattress 73 is not limited to the abovementioned example, but may be provided above or lateral to the main mattress 60, for example, or may be independent of the main mattress 60.

A pump unit 80 (air blowing adjustment apparatus) is mounted below the sections 23 of the bed 20, for example. The pump unit 80 controls the hardness of each air cell 55 by supplying and exhausting the air to and from each air cell 55 of the air mattress 50. As illustrated in FIG. 2, the pump unit 80 includes an air blowing section 81, a solenoid valve unit 82, the mattress controller 83, and an air pressure sensor 84.

In the air mattress 50, a flow path 90 (pipeline) that connects the air blowing section 81 to the plurality of air cells 55 is provided. As illustrated in FIG. 2, the flow path 90 includes a first flow path part 91 and a second flow path part 92. The first flow path part 91 is connected to the air blowing section 81. The first flow path part 91 establishes a connection between the air blowing section 81 and a solenoid valve in the solenoid valve unit 82.

The second flow path part 92 connects the air cells 55 to the first flow path part 91. The second flow path part 92 establishes a connection between the air cells 55 and the solenoid valve in the solenoid valve unit 82. A plurality of the second flow path parts 92 are provided so as to correspond to the plurality of air supply/exhaust systems. Each second flow path part 92 supplies the air sent from the air blowing section 81 via the first flow path part 91 and the solenoid valve unit 82 to the air cell group to which each second flow path part 92 is connected. In FIG. 2, for convenience, the second flow path part 92 is collectively illustrated for each mattress in a simplified manner.

More specifically, as illustrated in FIG. 3, as the plurality of second flow path parts 92, second flow path parts 92*a*, 92*b*, and 92*c* are provided. The second flow path parts 92*a*, 92*b*, and 92*c* are respectively connected to the first air cell group 61, the second air cell group 62, and the third air cell group 63. As illustrated in FIG. 4, as the plurality of second flow path parts 92, second flow path parts 92*d*, 92*e*, 92*f*, 92*g*, 92*h*, and 92*i* are provided. The second flow path parts 92*d*, 92*e*, 92*f*, 92*g*, 92*h*, and 92*i* are respectively connected to the first head part air cell 71*a*, the second head part air cell 71*b*, the left shoulder part air cell 72*a*, the right shoulder part air cell 72*b*, the left lower body air cell 73*a*, and the right lower body air cell 73*b*.

The air blowing section 81 supplies the air to the main mattress 60, the head part mattress 71, the shoulder part mattress 72, and the lower body mattress 73, via the flow path 90. Specifically, the air blowing section 81 supplies the air to each air cell group (each of the first air cell group 61, the second air cell group 62, the third air cell group 63, the first head part air cell 71*a*, the second head part air cell 71*b*, the left shoulder part air cell 72*a*, the right shoulder part air cell 72*b*, the left lower body air cell 73*a*, and the right lower body air cell 73*b*), via the solenoid valve unit 82. The air blowing section 81 is an electric air pump (pump main body). The mattress controller 83 controls an operation of the air blowing section 81.

The solenoid valve unit 82 is positioned between the air cells 55 (the air cells 55 of each of the main mattress 60, the head part mattress 71, the shoulder part mattress 72, and the lower body mattress 73) and the air blowing section 81. The solenoid valve unit 82 includes a plurality of solenoid valves provided to the flow path 90. The solenoid valve unit 82 may include a manifold.

For example, each solenoid valve is provided so as to correspond to each of the first air cell group 61, the second air cell group 62, the third air cell group 63, the first head part air cell 71*a*, the second head part air cell 71*b*, the left shoulder part air cell 72*a*, the right shoulder part air cell 72*b*, the left lower body air cell 73*a*, and the right lower body air cell 73*b*. In other words, the same solenoid valve is used for the air cells 55 that are commonly controlled.

The solenoid valve unit 82 includes an exhaust valve (not illustrated) that exhausts the air in each air cell 55 to the outside. The exhaust valve is connected to the flow path 90 on a first flow path part 91 side from the solenoid valve. When the exhaust valve is opened, the first flow path part 91 communicates with the outside to allow the air to be discharged from the first flow path part 91 to the outside. When the exhaust valve is closed, the first flow path part 91 is cut off from the outside. It is also possible to provide another exhaust valve on an air blowing section 81 side, different from the flow path 90, and exhaust the air sucked from the air cell group by reversely operating the air blowing section, from another valve.

Each of the plurality of solenoid valves in the solenoid valve unit 82 opens and closes between the first flow path part 91 and each of the second flow path parts 92. Opening the solenoid valve indicates opening between the first flow path part 91 and the second flow path part 92, in other words, communicating with the first flow path part 91 and the second flow path part 92. When the air blowing section 81 actuates in a state where the first flow path part 91 and the second flow path part 92 communicate with each other, the air from the air blowing section 81 is supplied to the air cells 55 connected to the relevant second flow path part 92. When the air blowing section 81 stops and the exhaust valve of the flow path 90 opens in a state where the first flow path part 91 and the second flow path part 92 communicate with each other, the air in the air cells 55 connected to the relevant second flow path part 92 is exhausted. Closing the solenoid valve indicates closing between the first flow path part 91 and the second flow path part 92, in other words, cutting off the air flow between the first flow path part 91 and the second flow path part 92.

A solenoid valve can be used as the exhaust valve. However, in the description of the embodiment, the solenoid valve simply referred indicates the solenoid valve (valve that opens and closes between the first flow path part 91 and each second flow path part 92) other than the exhaust valve.

The mattress controller 83 includes a control circuit that controls operations of the air blowing section 81 and the solenoid valve unit 82. The mattress controller 83 controls opening and closing operations of each solenoid valve and the exhaust valve. In other words, the mattress controller 83 controls the solenoid valve unit 82 to switch communicating-with/cutting-off between the selected second flow path part 92 among the plurality of second flow path parts 92 and the first flow path part 91. The mattress controller 83 opens and closes the solenoid valve to switch communicating-with/cutting-off between the air blowing section 81 and each air cell group. The mattress controller 83 selectively controls air-supply and exhaust of the plurality of air cell groups.

In this manner, the mattress controller 83 changes the internal pressure in each air cell group. Accordingly, the mattress controller 83 controls the hardness of the mattress 52. The mattress controller 83 includes a memory 83*a* in which a control program for controlling the internal pressure in each air cell group is stored. The memory 83*a* may be an arbitrary storage device, such as a ROM or a RAM.

The mattress controller 83 is connected to the mattress user interface device 85, which is described later, and controls the actuation of the air blowing section 81 and the opening and closing operation of the solenoid valve unit 82 based on a command signal from the mattress user interface device 85 (internal pressure change control). For example, a control program based on a command signal from the mattress user interface device 85 is stored in the memory 83*a*.

The mattress controller 83 controls the actuation of the air blowing section 81 and the opening and closing operation of the solenoid valve unit 82 based on a command signal transmitted from the bed controller 39 (internal pressure change control). For example, a control program based on a command signal from the bed controller 39 is stored in the memory 83*a*. The mattress controller 83 may be able to control the air cells 55 based on back angle information on the bed acquired by an angle sensor provided to the mattress itself, and the like, without communicating with the bed. The mattress controller 83 decreases the internal pressure in the air cells 55 of the main mattress 60 or increases the internal pressure of at least any of the head part mattress, the shoulder part mattress, and the lower body mattress, in a case where the angle sensor 87 or the like has detected the back angle equal to or lager than a predetermined angle, for example.

The air pressure sensor 84 measures internal pressure in the first flow path part 91. In other words, the air pressure sensor 84 measures internal pressure in the flow path 90 on a side closer to the air blowing section 81 than the solenoid valve. The internal pressure in the first flow path part 91 to be measured by the air pressure sensor 84 may be internal pressure in the manifold of the solenoid valve unit 82 (for example, internal pressure in a tube connected to the manifold). In other words, the first flow path part 91 may include a part of the manifold of the solenoid valve unit 82.

The air pressure sensor 84 detects internal pressure in the first flow path part 91 in a state where the first flow path part 91 and the second flow path part 92 communicate with each other, thereby detecting internal pressure in the air cell group connected to the relevant second flow path part 92.

The mattress controller 83 acquires a detection value by the air pressure sensor 84. The mattress controller 83 controls, based on the detection value by the air pressure sensor 84, the actuation of the air blowing section 81 and the opening and closing operations of the respective solenoid valves in the solenoid valve unit 82.

The mattress controller 83 includes a body pressure mode in which the body pressure of the user H on the mattress 52 is dispersed. A control program for the body pressure mode is stored in the memory 83*a*. In this example, the bed controller 39 and the mattress controller 83 have been described as separate controllers but are not limited thereto, and the bed controller 39 and the mattress controller 83 may be configured as one controller. The bed controller 39 and the mattress controller 83 can be integrally or dispersedly provided as appropriate.

The mattress user interface device 85 is a remote controller that is operated in order to change the internal pressure in the plurality of air cells 55. The mattress user interface device 85 is connected to the mattress controller 83 in a wired or wireless manner. The user H and a care giver can change the internal pressure (hardness) in each air cell group by operating the mattress user interface device 85. Manual setting in which the hardness of the air cell group is manually set by the operation of the mattress user interface device 85, and automatic setting in which a body weight of the user H is estimated, and the hardness is automatically set based on the estimation result, may be possible.

The mattress user interface device 85 includes a body pressure mode button 85*a* that is operated for causing the mattress controller 83 to execute the body pressure mode. Each operation button may be a press button, or may be a touch panel or the like.

In a case where the body pressure mode button 85*a* of the mattress user interface device 85 is operated, the mattress controller 83 executes the air supply/exhaust control of the first air cell group 61 to the third air cell group 63 (internal pressure change control), based on the control program for the body pressure mode stored in the memory 83*a*.

As one example, the mattress controller 83 firstly causes the air cells 55 in the first air cell group 61 to exhaust the air. This decreases the internal pressure in the air cells 55 denoted by "1" in FIG. 3. Next, after supplying the air to the air cells 55 in the first air cell group 61, the mattress controller 83 causes the air cells 55 in the second air cell group 62 to exhaust the air. This decreases the internal pressure in the air cells 55 denoted by "2" in FIG. 3.

Next, after supplying the air to the air cells 55 in the second air cell group 62, the mattress controller 83 causes the air cells 55 in the third air cell group 63 to exhaust the air. This decreases the internal pressure in the air cells 55 denoted by "3" in FIG. 3. The mattress controller 83 then supplies the air to the air cells 55 in the third air cell group 63. This can lower a contact pressure between the user H and the main mattress 60 to allow the body pressure of the user H to be dispersed as a result, so that bedsore can be prevented from occurring in the user H.

In this manner, the mattress controller 83 can execute internal pressure change control to change the pressure in the air cells 55 by controlling the air blowing section 81 and the solenoid valve. As mentioned above, the internal pressure change control is, for example, control to change the internal pressure based on the operation of the mattress user interface device 85, and control to change the internal pressure based on an angle of the back section 23*a*.

In such internal pressure change control, the mattress controller 83 operates the air blowing section 81 at a duty ratio of a set value by pulse width modulation (PWM) control. In the PWM control, an ON period in which a current flows through the air blowing section 81, and an OFF period in which the current flowing through the air blowing section 81 is cut off, are repeated. The duty ratio is a ratio of the ON period with respect to the cycle. In this example, a reference value (for example, initial value) of a set value of the duty ratio for the operation of the air blowing section 81 in the internal pressure change control is 35%.

The mattress controller 83 can execute duty adjustment control, different from the internal pressure change control. The duty adjustment control is control for adjusting (updating) the set value of the duty ratio for the operation of the air blowing section 81 in the internal pressure change control. Specifically, in the duty adjustment control, the air pressure sensor 84 measures closing pressure, which is described later. In the duty adjustment control, based on the measured closing pressure, the duty ratio for the operation of the air blowing section 81 in the internal pressure change control is adjusted.

The closing pressure is internal pressure in the first flow path part 91 in a state where the solenoid valves of the solenoid valve unit 82 close between the first flow path part 91 and the plurality of second flow path parts 92, and the air blowing section 81 performs an operation of sending the air into the first flow path part 91 (toward the solenoid valve).

For example, the closing pressure is pressure when the pump unit 80 is closed, in other words, pressure when the first flow path part 91 is cut off from all the lines to be connected to the first flow path part 91. In other words, the closing pressure is pressure in a state where all the valves that open and close the first flow path part 91 are closed. Specifically, for example, the closing pressure is pressure in a state where all the solenoid valves that open and close between the first flow path part 91 and the plurality of second flow path parts 92, and the exhaust valve are closed.

For example, when the duty ratio is constant, it can be considered that the size of the closing pressure corresponds to the size of the air-supply amount with respect to the air cells 55 in the internal pressure change control. The air-supply amount is, for example, the amount of the air to be supplied per unit time, and corresponds to a change speed of the internal pressure. In a case where the closing pressure is small, the air-supply amount with respect to the air cells 55 is assumed to be less. For example, in a case where the closing pressure is small, the mattress controller 83 updates the duty ratio to a larger value. The mattress controller 83 operates the air blowing section 81 at the updated duty ratio by the duty adjustment control, in the internal pressure change control. For example, the duty ratio in the internal pressure change control is updated to be a larger value to increase the air-supply amount with respect to the air cells 55 in the internal pressure change control. With the embodiment, by adjusting the duty ratio for the operation of the air blowing section 81 by the duty adjustment control, it is possible to adjust the air-supply amount with respect to the air cells 55.

Meanwhile, in the mattress, due to various factors including the manufacturing fluctuation and the aged deterioration of various kinds of members configuring the mattress, and environment change in temperature, humidity, and the like, fluctuation may occur in the air-supply performance with respect to the air cells. For example, the discharge amount of the air by a pump when the pump is operated at a predetermined duty ratio, varies for each product and changes with age. In the related art, since, without considering the fluctuation in the air-supply performance of the pump for each product and the change with age, the pump is operated at a predetermined duty ratio set in advance, the amount of air to be supplied to the air cells per unit time has varied for each product and has changed with age in some cases. The air-supply time (operation time of the pump that is needed until the internal pressure of the air cell becomes a predetermined value) of the air cell has varied for each product, and has changed with age in some cases.

In the internal pressure change control, for example, as the duty ratio of the air blowing section 81 becomes large, the output from the air blowing section 81 (for example, the air discharge amount per unit time) becomes large, the air-supply amount with respect to the air cells 55 increases, and the air-supply time of the air cells 55 becomes short. In the embodiment, the output from the air blowing section 81 is adjusted by adjusting the duty ratio in accordance with the measured closing pressure, so that it is possible to adjust the air-supply time of the air cells 55.

Figure 5:
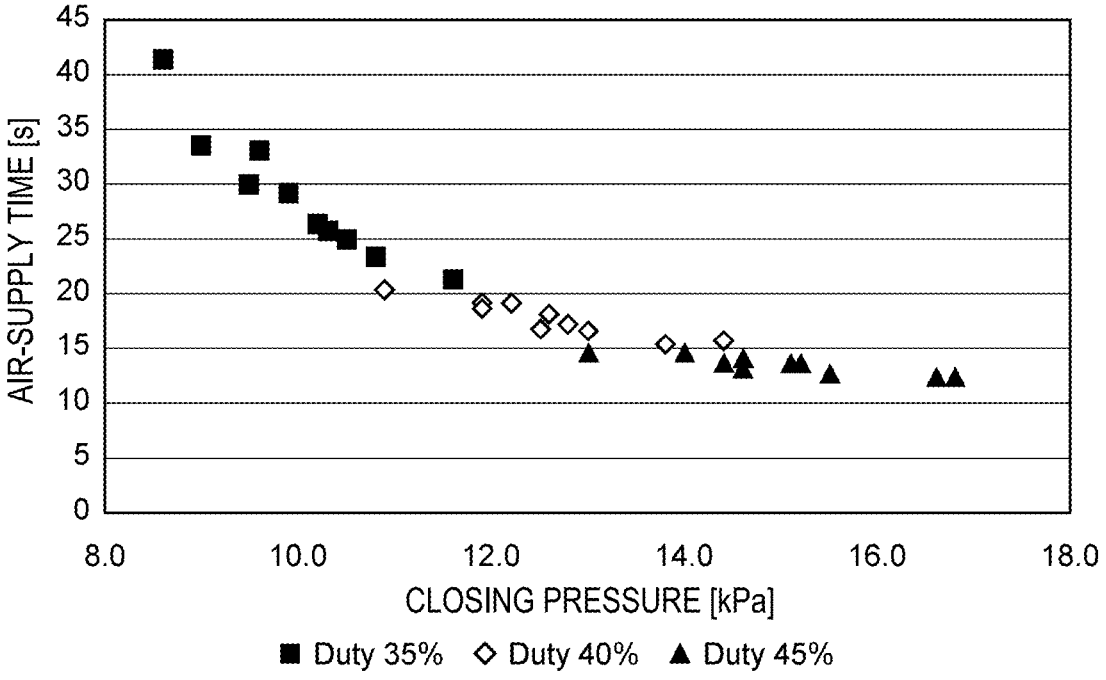
FIG. 5 is a graph illustrating an example of a relation between the closing pressure and air-supply time.

FIG. 5 is a graph illustrating an example of a relation between the closing pressure and air-supply time.

FIG. 5 illustrates data when the duty ratio is 35%, 40%, and 45%. In FIG. 5, as the closing pressure becomes low, the air-supply time of the air cells 55 in the internal pressure change control becomes long. At the different duty ratios, if the closing pressure is approximate, the air-supply time is also approximate. This suggests that adjusting the duty ratio so as to obtain the approximate closing pressure can control the air-supply time.

Therefore, the duty ratio of the air blowing section 81 is more appropriately adjusted in accordance with the closing pressure so as to prevent the air-supply time from becoming long, for example. Adjusting the duty ratio can prevent the air-supply time from fluctuating. For example, even with the fluctuations of the characteristics of various kinds of members such as the air blowing section 81, it is possible to obtain the suitable internal pressure and air-supply time of the air cells 55. With the embodiment, the usability of the air mattress can be improved.

As one example, the mattress controller 83 sets (updates) the duty ratio of the air blowing section 81 in the internal pressure change control to a value (X) that is calculated by the following expression (1).

$$X=(P_{target}-P_{closing})\times 2.17+35 \quad (1)$$

The mattress controller 83 sets the duty ratio in the internal pressure change control to a value calculated by the expression (1), until next duty adjustment control, for example.

The abovementioned expression (1) is an expression in a case where the duty ratio for the operation of the air blowing section 81 in the measurement of closing pressure is set to a predetermined value (reference value (35%)). In this example, closing pressure to be measured is pressure when the air blowing section 81 is operated at the predetermined duty ratio (reference value (35%)), for a predetermined time (for example, about several seconds). $P_{target}$ is a predetermined value determined in advance, and a target value of the closing pressure. $P_{target}$ is 12 kPa, for example. $P_{closing}$ is a measurement value of the actually measured closing pressure in the duty adjustment control. The second term of the expression (1) is the duty ratio (reference value (35%)) when the closing pressure is actually measured. The coefficient (2.17) in the first term of the expression (1) is an increase amount of the duty ratio that is needed to make the closing pressure large by 1 kPa.

The expression (1) is determined based on a relation between the duty ratio acquired in advance and the closing pressure. As is understood from the expression (1), in the duty adjustment control, the duty ratio is updated based on a difference between the measured closing pressure ($P_{closing}$) and the predetermined value ($P_{target}$). If the measured closing pressure ($P_{closing}$) is smaller than the predetermined value ($P_{target}$), the duty ratio is set to the value made larger by a value in accordance with the difference than the value (reference value (35%)) when the closing pressure has been measured. In other words, in the duty adjustment control, the duty ratio is corrected from the reference value (35%) such that the closing pressure approximates to the target value. For example, in the duty adjustment control, the duty ratio in the internal pressure change control is set to a value of the duty ratio at which the closing pressure becomes the target value.

In the duty adjustment control, the duty ratio may be updated every time when the closing pressure is measured. The duty adjustment control is not limited thereto, but may be control in which the duty ratio is updated if the measured closing pressure satisfies a predetermined condition. For example, in the duty adjustment control, if the closing pressure ($P_{closing}$) is smaller than the predetermined value ($P_{target}$), the duty ratio is set to a value larger than the value when the closing pressure has been measured. On the other hand, if the closing pressure ($P_{closing}$) is equal to or larger than the predetermined value ($P_{target}$), the duty adjustment control may be control in which the duty ratio is not updated or is set to the value (reference value (35%)) when the closing pressure has been measured. For example, the duty ratio is updated if necessary to result in the smaller number of change in the duty ratio and a stable operation. For example, if the measured closing pressure ($P_{closing}$) is larger than the predetermined value ($P_{target}$), the duty ratio may be made small.

The mattress controller 83 may automatically and periodically execute the duty adjustment control, for example. In other words, for example, the mattress controller 83 executes again the duty adjustment control when a first predetermined time has elapsed from the previous execution of the duty adjustment control (for example, processing to be described later in relation to FIG. 6). Accordingly, for example, if a latest measurement value of the closing pressure is smaller than the target value, the duty ratio is updated. In the internal pressure change control, the air blowing section 81 is operated at the updated latest duty ratio. The first predetermined time may be, for example, equal to or larger than one hour and equal to or less than ten hours, as one example, is about six hours.

In a case where the mattress controller 83 executes internal pressure change control after the first predetermined time has elapsed from the previous execution of the duty adjustment control, the mattress controller 83 may execute duty adjustment control before the execution of the internal pressure change control. For example, if the mattress controller 83 determines the execution of internal pressure change control based on an operation of the mattress user interface device 85 by the user H, the mattress controller 83 executes the duty adjustment control immediately before the internal pressure change control. The mattress controller 83 may execute the duty adjustment control every time before internal pressure change control.

In a case where the mattress controller 83 executes internal pressure change control within a second predetermined time from when power is applied to the mattress controller 83, the mattress controller 83 may execute the duty adjustment control before the internal pressure change control. The second predetermined time may be, for example, equal to or larger than one hour and equal to or less than ten hours, as one example, is about three hours. The second predetermined time may be a time shorter than the first predetermined time.

In this manner, the duty adjustment control is automatically executed, for example, so that it is possible to appropriately adjust the air-supply time of the air cells 55 and improve the usability more.

Figure 6:
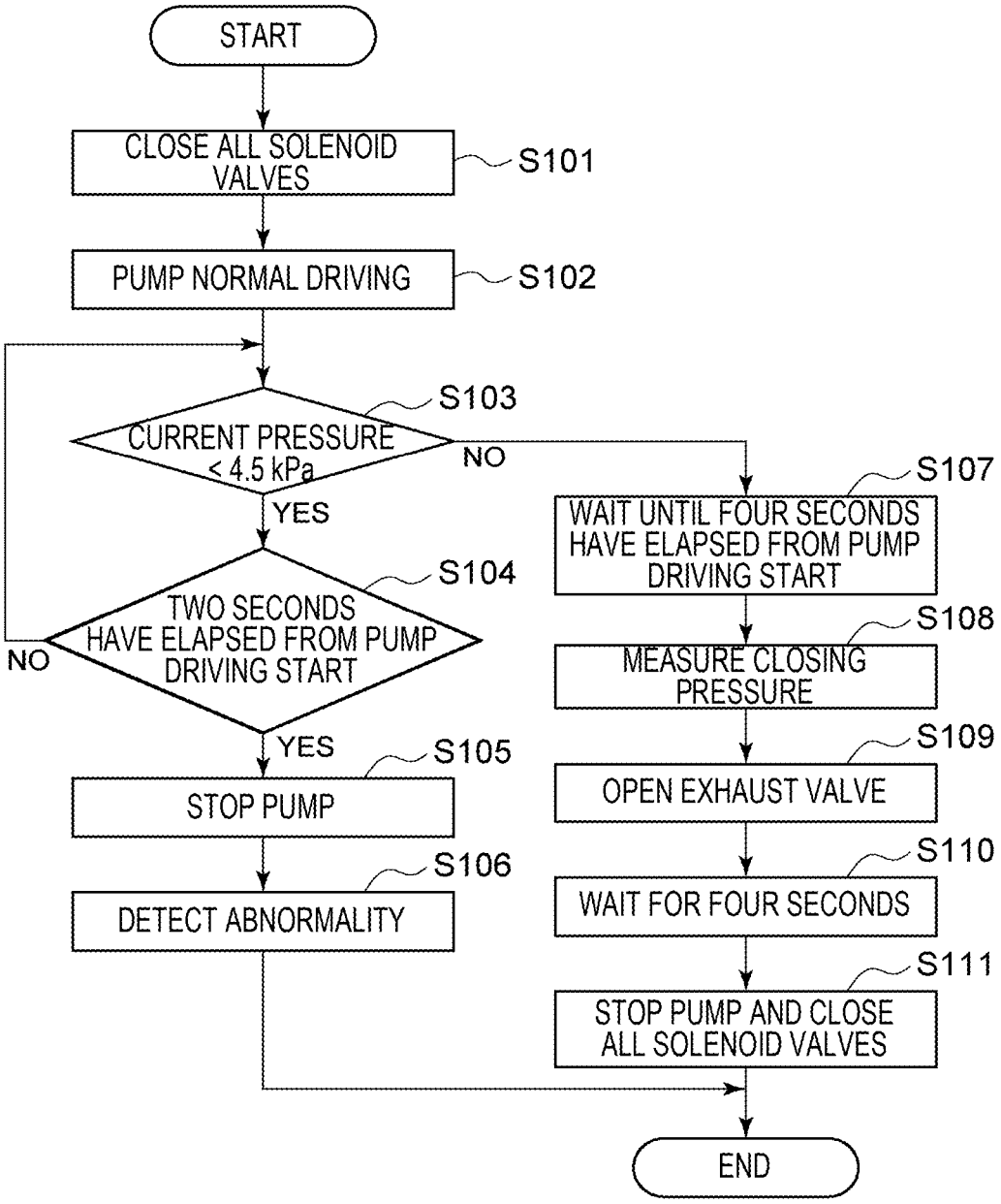
FIG. 6 is a flowchart illustrating an example of measurement of the closing pressure.

FIG. 6 is a flowchart illustrating an example of measurement of the closing pressure.

The mattress controller 83 closes all the solenoid valves in the solenoid valve unit 82 (step S101). The mattress controller 83 closes all the exhaust valves provided to the pump unit 80, for example.

The mattress controller 83 operates the air blowing section 81 (pump) to send the air into the first flow path part 91 (step S102).

The mattress controller 83 acquires a detection value by the air pressure sensor 84, in other words, current internal pressure of the first flow path part 91 (step S103) If the acquired detection value is less than a predetermined value (in this example, 4.5 kPa) (step S103: YES), and a third predetermined time (in this example, two seconds) does not elapse from the operation start of the air blowing section 81 (step S104: NO), the mattress controller 83 acquires again a detection value by the air pressure sensor 84 (step S103).

If the third predetermined time has elapsed from the operation start of the air blowing section 81 while the detection value by the air pressure sensor 84 remains less than the predetermined value (step S104: YES), the mattress controller 83 stops the operation of the air blowing section 81 (step S105). In this case, the mattress controller 83 determines that an abnormality occurs (step S106), and does not perform the adjustment of the duty ratio.

If the detection value by the air pressure sensor 84 has exceeded the predetermined value (step S103: NO), and a fourth predetermined time (in this example, four seconds) has elapsed from the operation start of the air blowing section 81 (step S107), the mattress controller 83 measures closing pressure (step S108). In other words, the mattress controller 83 sets a detection value by the air pressure sensor 84 after the fourth predetermined time from the operation start of the air blowing section 81, as closing pressure. The mattress controller 83 then updates the duty ratio if necessary based on the measured closing pressure and the above-mentioned expression (1).

The mattress controller 83 opens the exhaust valve (step S109), and stops the operation of the air blowing section 81 (step S111) if the predetermined time (in this example, four seconds) has elapsed (step S110). All of the solenoid valves are in the closed state.

The third predetermined time and the fourth predetermined time are not limited to the above, but, for example, may be about equal to or larger than one second and equal to or less than ten seconds. The fourth predetermined time is longer than the third predetermined time.

In this manner, for example, if the internal pressure becomes larger than the predetermined pressure within the third predetermined time from when the operation of the air blowing section 81 is started in a state where the solenoid valves are closed (step S103: NO), the mattress controller 83 performs the duty adjustment control (step S108). On the other hand, for example, if the internal pressure does not become larger than the predetermined pressure within the third predetermined time from when the operation of the air blowing section 81 is started in a state where the solenoid valves are closed, (step S104: YES), the mattress controller 83 does not perform the duty adjustment control. With steps S103 and S104, the mattress controller 83 can update the duty ratio after checking whether an abnormality occurs in the pump operation.

The mattress controller 83 may perform the exhaust operation before step S101. In the exhaust operation, for example, in a state where the air blowing section 81 is stopped, the exhaust valve is opened to discharge the air in the flow path 90 (and in the air cells) to the outside. After the exhaust operation, the mattress controller 83 may execute step S101 after checking the detection value by the air pressure sensor 84 is equal to or less than the predetermined value (for example, equal to or less than 1.2 kPa). The closing pressure may be a detection value by the air pressure sensor 84 when the pump is operated for a predetermined time from a state where a detection value by the air pressure sensor 84 is a predetermined value (or equal to or less than the predetermined value) in a discharge state.

The embodiment may include the following configurations.

(Configuration 1)

An air blowing adjustment apparatus including:

a controller configured to control an air blowing section configured to supply air to an air cell, in which a flow path that connects the air blowing section to the air cell includes a first flow path part connected to the air blowing section and a second flow path part that connects the air cell to the first flow path part, and is provided with a solenoid valve configured to open and close between the first flow path part and the second flow path part, and the controller is configured to perform, based on closing pressure that is internal pressure in the first flow path part when the solenoid valve is closed and the air blowing section is operated, duty adjustment control to update a duty ratio in the operation of the air blowing section.

(Configuration 2)

The air blowing adjustment apparatus according to configuration 1, in which in the duty adjustment control, the duty ratio is updated based on a difference between the measured closing pressure and a predetermined value.

(Configuration 3)

The air blowing adjustment apparatus according to configuration 2, in which in the duty adjustment control, when the measured closing pressure is smaller than the predetermined value, the duty ratio is set to a value larger than the value when the closing pressure has been measured.

(Configuration 4)

The air blowing adjustment apparatus according to configuration 2 or 3, in which in the duty adjustment control, when the measured closing pressure is equal to or larger than the predetermined value, the duty ratio is not updated, or is set to the value when the closing pressure has been measured.

(Configuration 5)

The air blowing adjustment apparatus according to any one of configurations 1 to 4, in which the controller executes again the duty adjustment control when a predetermined time elapses from previous execution of the duty adjustment control.

(Configuration 6)

The air blowing adjustment apparatus according to any one of configurations 1 to 5, in which the controller can execute internal pressure change control to change pressure in the air cell by controlling the air blowing section and the solenoid valve, and executes, when executing the internal pressure change control after a first predetermined time has elapsed from the previous execution of the duty adjustment control, the duty adjustment control before executing the internal pressure change control.

(Configuration 7)

The air blowing adjustment apparatus according to any one of configurations 1 to 6, in which the controller can execute internal pressure change control to change pressure in the air cell by controlling the air blowing section and the solenoid valve, and executes, when executing the internal pressure change control within a second predetermined time after power is supplied to the controller, the duty adjustment control before executing the internal pressure change control.

(Configuration 8)

The air blowing adjustment apparatus according to any one of configurations 1 to 7, in which the controller executes the duty adjustment control, when the internal pressure becomes larger than predetermined pressure within a third predetermined time after the operation of the air blowing section is started in a state where the solenoid valve is closed, and does not execute the duty adjustment control, when the internal pressure does not become larger than the predetermined pressure within the third predetermined time after the operation of the air blowing section is stared in a state where the solenoid valve is closed.

(Configuration 9)

Bedding including:

the air blowing adjustment apparatus according to any one of configurations 1 to 8; and the air cell.

While certain embodiments have been described, these embodiments have been presented by way of example only, and are not intended to limit the scope of the inventions.

Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An air blowing adjustment apparatus comprising:

a controller configured to control an air blowing section configured to supply air to an air cell, wherein a flow path that connects the air blowing section to the air cell includes a first flow path part connected to the air blowing section and a second flow path part that connects the air cell to the first flow path part, and is provided with a solenoid valve configured to open and close between the first flow path part and the second flow path part, and the controller is configured to perform, based on closing pressure that is internal pressure in the first flow path part when the solenoid valve is closed and the air blowing section is operated, duty adjustment control to update a duty ratio in the operation of the air blowing section.

2. The air blowing adjustment apparatus according to claim 1, wherein in the duty adjustment control, the duty ratio is updated based on a difference between the measured closing pressure and a predetermined value.

3. The air blowing adjustment apparatus according to claim 2, wherein in the duty adjustment control, when the measured closing pressure is smaller than the predetermined value, the duty ratio is set to a value larger than the value when the closing pressure has been measured.

4. The air blowing adjustment apparatus according to claim 2, wherein in the duty adjustment control, when the measured closing pressure is equal to or larger than the predetermined value, the duty ratio is not updated, or is set to the value when the closing pressure has been measured.

5. The air blowing adjustment apparatus according to claim 1, wherein the controller executes again the duty adjustment control when a predetermined time elapses from previous execution of the duty adjustment control.

6. The air blowing adjustment apparatus according to claim 1, wherein the controller can execute internal pressure change control to change pressure in the air cell by controlling the air blowing section and the solenoid valve, and executes, when executing the internal pressure change control after a first predetermined time has elapsed from the previous execution of the duty adjustment control, the duty adjustment control before executing the internal pressure change control.

7. The air blowing adjustment apparatus according to claim 1, wherein the controller can execute internal pressure change control to change pressure in the air cell by controlling the air blowing section and the solenoid valve, and executes, when executing the internal pressure change control within a second predetermined time after power is supplied to the controller, the duty adjustment control before executing the internal pressure change control.

8. The air blowing adjustment apparatus according to claim 1, wherein the controller executes the duty adjustment control, when the internal pressure becomes larger than predetermined pressure within a third predetermined time after the operation of the air blowing section is started in a state where the solenoid valve is closed, and does not execute the duty adjustment control, when the internal pressure does not become larger than the predetermined pressure within the third predetermined time after the operation of the air blowing section is stared in a state where the solenoid valve is closed.

9. Bedding comprising:

the air blowing adjustment apparatus according to claim 1; and the air cell.

* * * * *